US008998664B2

(12) United States Patent
Sells

(10) Patent No.: US 8,998,664 B2
(45) Date of Patent: Apr. 7, 2015

(54) SKIER CONTROLLED WATERCRAFT

(71) Applicant: Robin Sells, Newcastle, WA (US)

(72) Inventor: Robin Sells, Newcastle, WA (US)

( * ) Notice: Subject to any disclaimer, the term of this patent is extended or adjusted under 35 U.S.C. 154(b) by 0 days.

(21) Appl. No.: 13/919,876

(22) Filed: Jun. 17, 2013

(65) Prior Publication Data

US 2014/0150702 A1 Jun. 5, 2014

Related U.S. Application Data

(63) Continuation of application No. 13/230,710, filed on Sep. 12, 2011, now Pat. No. 8,465,333.

(51) Int. Cl.

| | |
|---|---|
| ***B63B 35/85*** | (2006.01) |
| ***B63H 25/02*** | (2006.01) |
| ***B63C 9/00*** | (2006.01) |
| ***B63H 21/22*** | (2006.01) |
| *B63B 35/81* | (2006.01) |

(52) U.S. Cl.

CPC ..... *B63H 25/02* (2013.01); *B63C 9/0005* (2013.01); *B63H 21/22* (2013.01); *B63B 35/817* (2013.01)

(58) Field of Classification Search

USPC ..... 441/89, 69; 440/1

See application file for complete search history.

(56) References Cited

U.S. PATENT DOCUMENTS

| | | | | |
|---|---|---|---|---|
| 7,389,165 | B2 * | 6/2008 | Kaji | 701/21 |
| 8,465,333 | B2 * | 6/2013 | Sells | 441/69 |

* cited by examiner

*Primary Examiner* — Stephen Avila

(74) *Attorney, Agent, or Firm* — Dean A. Craine

(57) ABSTRACT

A water ski handle system used with a personal water ski towing watercraft that includes a handle component that selectively attaches to a standard water ski handle and contains a manual control module. The control module includes directional control buttons, power ON and OFF buttons, and power Up and Down buttons. Coupled to the control module is a self-correcting propulsion and steering system that senses undesirable changes to the watercraft's motion caused by the water-skier when pulled by the watercraft. When a difference is detected, a command module located in the watercraft automatically controls the watercraft's propulsion and steering systems so the watercraft follows the desired path and velocity. The system also includes an auto-back tracking feature that automatically reduces power to the last known marked geographic point the skier was upright.

3 Claims, 5 Drawing Sheets

SKIER CONTROLLED WATERCRAFT

This is a continuation application of U.S. utility patent application (application Ser. No. 13/230,710) filed on Sep. 12, 2011 (now U.S. Pat. No. 8,465,333) which was based on and claimed the benefit of U.S. Provisional patent application (Application No. 61,381,465) filed on Sep. 10, 2010.

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention relates to personal water skiing watercraft used for towing a skier, and more particular to such watercraft that is controlled and operated by a wireless communication link.

2. Description of the Related Art

U.S. Pat. No. 5,041,040 discloses a personal watercraft used to tow a skier. Attached to the stern of the watercraft is a tow rope with a handle attached to its distal end. Mounted on the handle are steering and propulsion control buttons used by the skier to control the watercraft.

Unfortuately, the watercraft disclosed in U.S. Pat. No. 5,041,040 must be used with the tow rope and the handle designed specifically to be used with the watercraft. For some water skiers who prefer to use a particular type of tow rope and handle, the system is unsatisfactory.

When skiing, the watercraft normally travels at a straight line and at a constant velocity. Because personal watercraft such as the one shown in U.S. Pat. No. 5,041,040 are relatively small, the side-to-side movement of an adult water skier will cause the direction and velocity of the watercraft to change. As a result, the water skier must constantly adjust the direction and velocity of the watercraft when skiing.

Another problem with skier controlled watercraft is that if the skier falls, the water-craft continues to travel a short distance away from the skier. The skier must then locate and swim to the handle in order to resume skiing.

What is needed is an improved skier control watercraft system that has a self-direction and speed correcting feature and an auto-return feature.

SUMMARY OF THE INVENTION

These and other objects of the invention are met by the improved skier controlled watercraft that includes a handle component that selectively attaches to a standard water ski handle and contains a manual control module and a wireless transmitter. The control module includes directional control buttons, power ON and OFF buttons, and power Up and Down buttons. Located in the watercraft is a wireless receiver that communicates with the transmitter located in the handle component. Coupled to the receiver is a self-correcting propulsion and steering system that senses undesirable changes to the watercraft's motion caused by the water-skier when towed by the watercraft. The self-correcting system includes a micro-electromechanical device and software program that compares the watercraft's current attitude, heading and speed, with the signals inputted by the user via the handle component. When a difference is detected, a command module located in the watercraft automatically controls the watercraft's propulsion and steering systems so the watercraft follows the desired path and velocity. The system also includes fallen skier detecting system and an auto-back tracking feature that monitors whether the skier is being towed, and automatically reduces power and back tracks to the last known marked geographic point the skier was upright.

DESCRIPTION OF THE PREFERRED EMBODIMENT(S)

Figure 5:
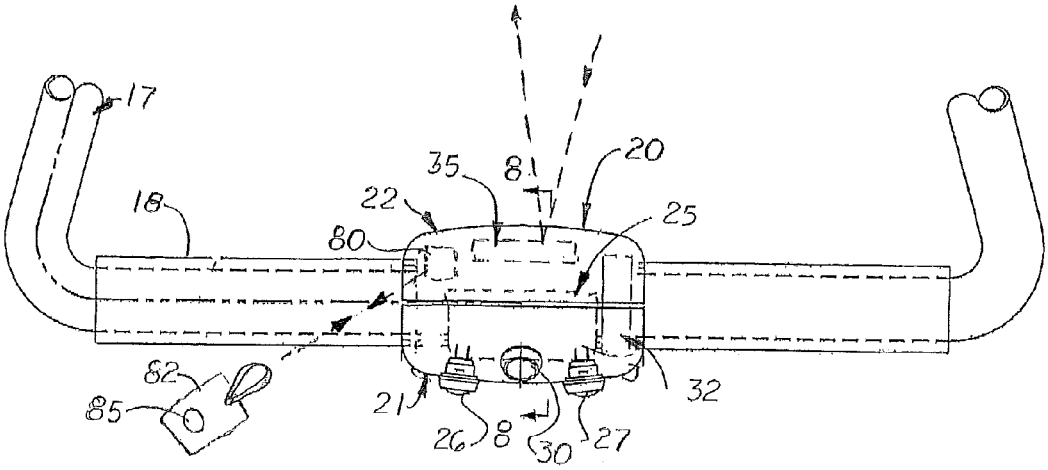
FIG. 5 is a top plan view of the handle.
Figure 6:
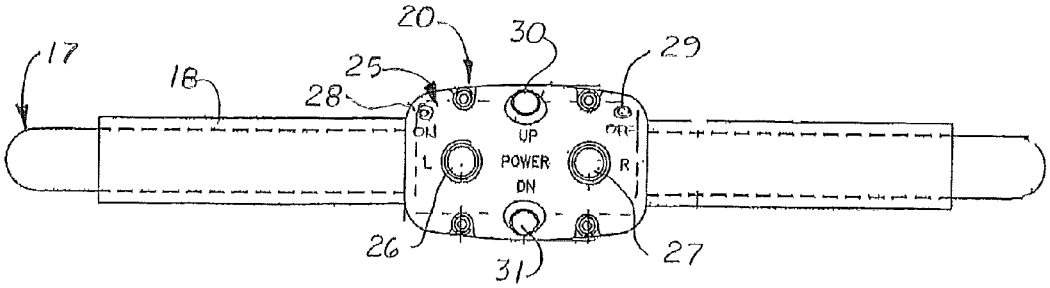
FIG. 6 is a rear elevational view of the handle shown in FIG. 5.
Figure 7:
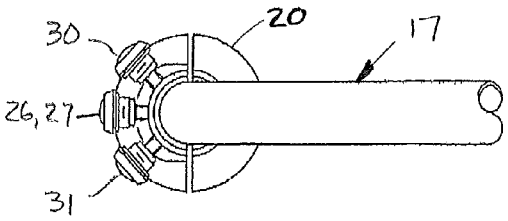
FIG. 7 is a side elevational view of the handle shown in FIGS. 5 and 6.
Figure 8:
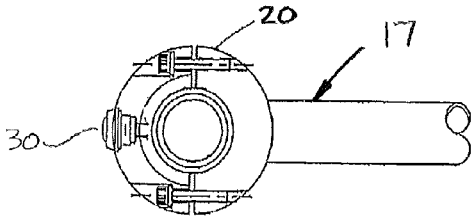
FIG. 8 is a sectional view of the handle taken along line 8-8 in FIG. 5.
Figure 9:
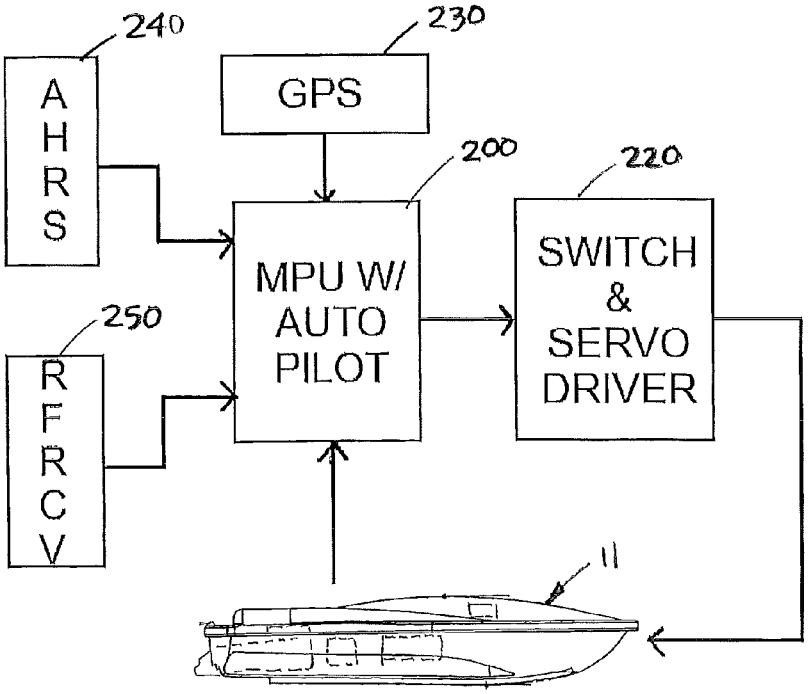
FIG. 9 is a flow chart control system used in the invention.

Referring to the accompanying Figs. there shown and described an improved skier controlled watercraft system 10 that includes a relatively small, lightweight watercraft hull 11 with an enclosed cover 12 and low center of gravity and specifically designed to resist the lateral forces exerted on the stern 13 of the hull 11 when towing a water skier. Located inside the hull 11 is a water jet propulsion and steering system 14. Attached to the stern 13 is a towing ring 16 which attaches to a standard water ski tow rope 15. Attached to the distal end of the towg rope 15 is a triangular-shaped handle 17 with a transversely aligned gripping leg 18 as shown in FIGS. 5 and 6.

Attached around the gripping leg 18 is a waterproof handle component 20. The handle component 20 is a hollow, clam shell structure with a front cover 21 and a rear cover 22 connected together via threaded connectors. Inside the handle component 20 is a manual control module 25 and a wireless transmitter 35. The control module 25 includes directional control buttons 26, 27, power ON and OFF buttons, 28, 29, and propulsion system power Up and Down buttons 30, 31. Located inside the handle 20 is a battery pack 32.

Figure 1:
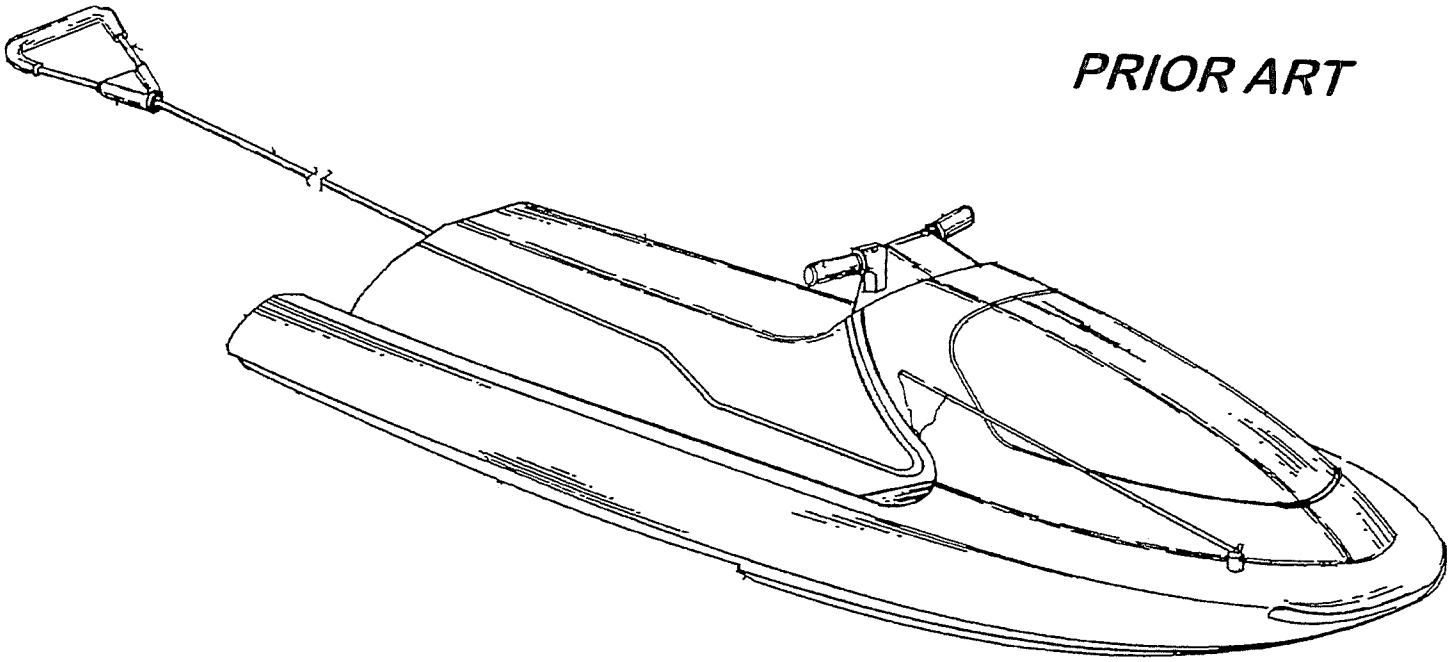
PRIOR ART FIG. 1
FIG. 1 is a perspective view of a skier controlled watercraft found in the prior art.
Figure 2:
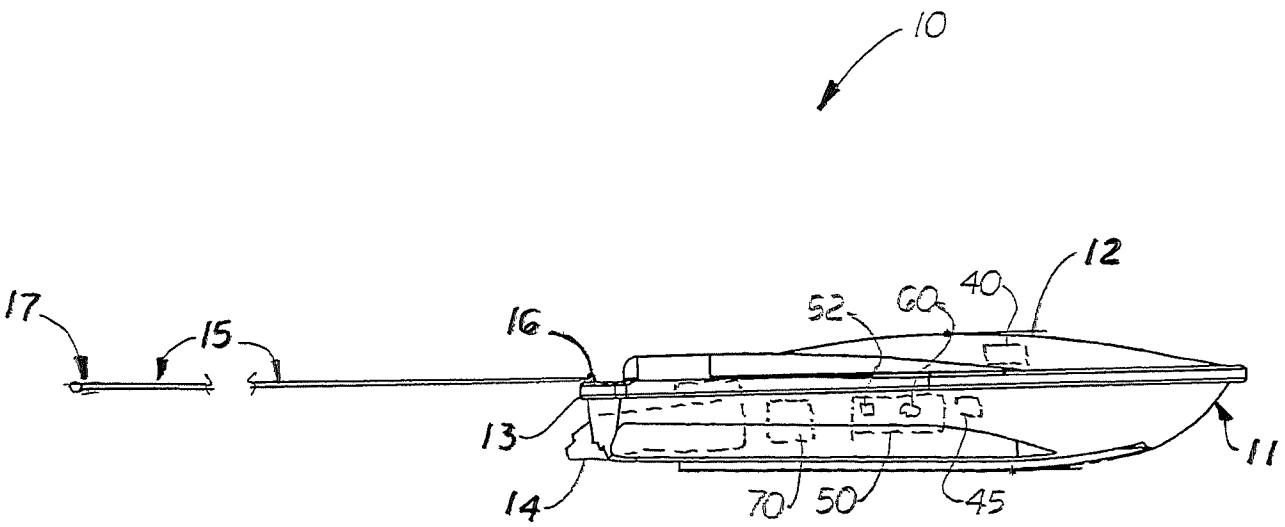
FIG. 2 is a side elevational view of the improved skier controlled watercraft disclosed herein.
Figure 3:
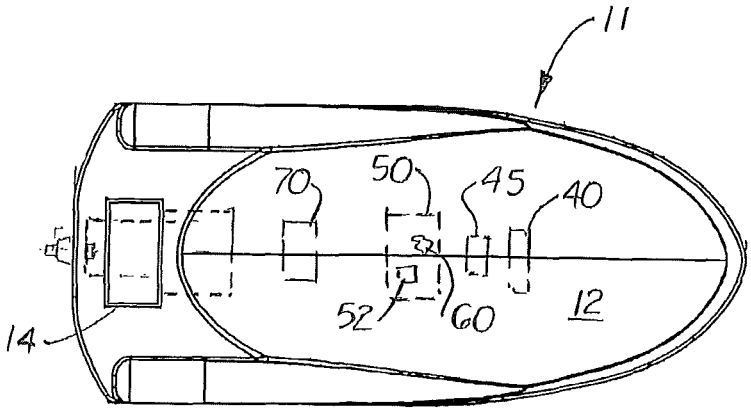
FIG. 3 is a to plan view of the watercraft hull used in the invention disclosed herein.
Figure 4:
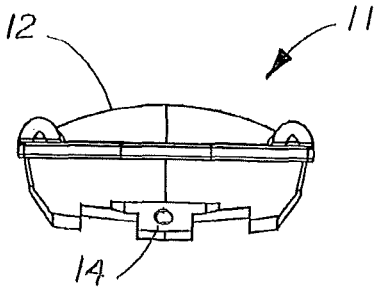
FIG. 4 is a rear elevational view of the watercraft hull shown in FIG. 3.

Referring to FIGS. 2-4. located in the hull 12 is a command module 40 and a wireless receiver 45 that communicates with the wireless transmitter 35 located in the handle component 20. Coupled to the wireless receiver 45 is a self-correcting propulsion and steering control module 50 that controls the water jet propulsion and steering system 14 and senses undesirable changes to the watercraft's motion caused by the water-skier when being pulled. As discussed further below, the control module 50 includes a fallen skier and an auto-back tracking feature. More specifically, the control module 50 includes a micro-electromechanical device 52 and software program 60 that compares the watercraft's current attitude, heading and speed, with the signals inputted by the user via the handle component 20. When a difference is detected, the control module 50 automatically controls the watercraft's propulsion and steering system 14 so the watercraft hull 10 follows a desired path and velocity.

The fallen water skier detecting feature uses an RFID detector 80 located in the handle component 20 and a hang tag 82 that includes an RFID button 85 that is detected by the RFID detector 80 when within 6 feet of each other. When the handle component 20 is release by the skier, the RFID detector 80 and RFID button 85 are outside the 6 foot range which automatically creates a wireless signal transmitted by the wireless transmitter 35 to the receiver 45 alerting the control module 50 that the skier has fallen.

When the fallen skier signal is detected, the auto-back tracking feature is initiated which causes the watercraft hull 11 to back track to the location just before a fallen skier alert signal was received. The control module 50 automatically instructs the propulsion and steering system 14 to reduce power and to back track to the last known marked geographic point the skier was upright.

Watercraft Attitude Sensing and Correction

More specifically, the control module 50 utilizes an Attitude Heading Reference System (AHRS) based on Micro-ElectroMechanical Systems (MEMS) technology to sense the undesired changes in the watercraft's motion induced from a relatively large and dynamic towed object, such as a water skier. The components compare the watercraft's present attitude, heading and speed to the desired parameters of a model of a much larger vehicle (speed boat) to create an error signal that is processed into commands for propulsion and steering adjustments. The propulsion and steering commands are then applied to the watercraft's propulsion and steering systemss to drive the overall system to closer emulate the characteristics of a much larger vehicle.

During use, GPS location information is being used to determine the skier's present location, velocity and heading. When a fallen skier signal is detected, the GPS data is automatically recorded. When the skier falls while skiing, the AHRS system may supplement the GPS position information during back tracking by providing detailed record of the vehicle orientation, tow load, and velocities that enable back tracking to the geographic point a payload is lost. When the MPU in the control module senses the skier is no longer being towed through a combination of vehicle measured parameters and the status of the water skiers remote control signals, it marks the corresponding geographic data point of the water skier, commands the throttle to low, then slowly drives the vehicle to the marked geographic point and loiters until the water skier resets via the remote or the system is secured.

MEMS devices are the de facto standard for attitude sensing solutions in consumer applications to include vehicles, appliances, smart phones, and other consumer products. They are a key component to such popular devises as the Segway, IPhone, and Wii game controllers to allow them to sense attitude and motion without cumbersome mechanical systems of the past. AHRS now incorporate MEMS devices to reduce size, cost, and power consumption. In the embodiment, disclosed herein, it is anticipated that the Landmark 10 LN manufactured by Gladiator Technologies, Inc will be the AHRS. It provides the required data via a RS-485 serial data stream, is small, requires little power and meets both accuracy and robustness requirements needed for this application.

The system uses a main processor unit (MPU) that conducts the algorithms for control compensation and autopilot. A small rapid development microcontroller (2×3 inches) based on an ARM processor (LPC2303) manufactured by Coridium, Inc is recommended for this purpose. The MPU accepts standard servo signals from the RF receiver and supplements or replaces them as required to implement both vehicle compensation and auto pilot functions based on information from AHRS, GPS, and the vehicle. The rapid prototype form will be replaced with smaller dual inline package form factor for production.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A water ski handle and control system for a personal water ski towing watercraft that includes a hull with a propulsion system and steering system located therein, attached to the hull is a tow rope and a handle, said system comprising:
   a. a waterproof handle component designed to connect to said handle, said handle component includes a watercraft control module with left and right turn buttons, power ON and OFF buttons and power Up and Down buttons, and a wireless transmitter;
   b. a wireless receiver configured to receive signals from said wireless transmitter;
   c. a command module located in said hull and coupled to said wireless receiver and coupled to said propulsion system and steering system; and,
   d. a self-correcting steering and velocity system coupled to said command module, said self-correcting steering and velocity system senses undesirable changes to the watercraft's motion caused by the water skier when being pulled by the watercraft, said self-correcting system includes a micro-electromechanical device and a software program that determines the watercraft's current attitude, heading and speed and compares it with command signals from the turn buttons, and power ON and Off buttons and said power UP and Down buttons on said handle component, when a difference in the attitude, heading and speed is detected, an error condition is detected by said command module that transmit direction and velocity correction signals to said propulsion and steering systems so that the watercraft continues to travel in the direction and at a velocity transmitted from said handle component.

2. The system as recited in claim 1, further including a water skier fallen system used to determine when the water skier has released or separated from said handle, said water skier fallen system being coupled to said command module, when said water skier fallen system determines that the water skier has released or separated from said handle, said control module controls said propulsion and driving systems so that the watercraft's velocity is reduced and returns to the location information transmitted by said wireless transmitter.

3. A watercraft control system, comprising:
   a. a watercraft hull;
   b. a propulsion system in said hull;
   c. a steering system in said hull;
   d. a command module located in said hull and coupled said propulsion and steering system; and,
   e. a self-correcting steering and velocity system coupled to said command module, said self-correcting system includes a micro-electromechanical device and a software program that determines the watercraft hull's current attitude, heading and speed and compares it to command signals from said propulsion and steering systems, when a difference in the attitude, heading and speed is detected, an error condition is detected by said command module that transmit direction and velocity correction signals to said propulsion and steering systems so that the watercraft continues to travel in the direction and at a velocity transmitted from said handle component; and, f. a water skier fallen system located in said hull that determines when a water skier has released or separated from said handle, said water skier fallen system being coupled to said command module, when said water skier fallen system determines that the water skier has released or separated from said handle, said control module controls said propulsion and driving system so that the watercraft's velocity is reduced and returns to the location information transmitted by said wireless transmitter.

* * * * *